United States Patent [19]

Harman

[11] 4,435,158

[45] * Mar. 6, 1984

[54] HEATED CHAMBER WALLS

[75] Inventor: Maurice Harman, Milton Keynes, England

[73] Assignee: The Energy Equipment Company Limited, Bedfordshire, England

[ * ] Notice: The portion of the term of this patent subsequent to Nov. 10, 1998 has been disclaimed.

[21] Appl. No.: 277,383

[22] Filed: Jun. 25, 1981

Related U.S. Application Data

[63] Continuation-in-part of Ser. No. 43,325, May 29, 1979, Pat. No. 4,299,562.

[30] Foreign Application Priority Data

May 30, 1978 [GB] United Kingdom ..... 24517/78

[51] Int. Cl.[3] ..... F27B 15/00; F23G 5/00; F23M 5/00; F27D 1/00

[52] U.S. Cl. ..... 432/58; 110/245; 110/336; 432/251

[58] Field of Search ..... 432/15, 58, 249, 251, 432/252; 110/245, 336; 122/4 D; 165/81, 95, 134 R; 52/573; 239/397.5

[56] References Cited

U.S. PATENT DOCUMENTS 2,959,355 11/1960 Houser ..... 239/397.5
4,299,562 11/1981 Harman ..... 432/58

*Primary Examiner*—J. Camby
*Attorney, Agent, or Firm*—Murray Schaffer

[57] ABSTRACT

A wall arrangement for a shell type chamber in which the wall is provided with gaps between them enabling expansion when the temperature of the chamber is increasing. The particular arrangement further provides means for preventing inert material packing said gaps which would prevent expansion of the walls. The means for preventing the insert material packing the gaps comprises gas injector means arranged to force gas into the gap.

9 Claims, 5 Drawing Figures

HEATED CHAMBER WALLS

RELATED APPLICATION

Figure 1:
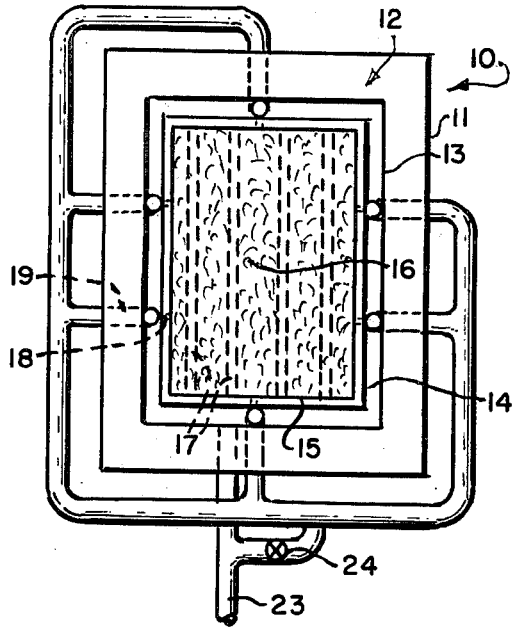

This is a continuation-in-part of Ser. No. 43,325 filed May 29, 1979, now U.S. Pat. No. 4,299,562, for which priority is claimed.

BACKGROUND OF THE INVENTION

The present invention relates to heated chambers, and is more particularly, but not exclusively concerned, with the wall arrangements of fluidised bed combustion chambers and the like.

The walls of any heated chamber expand when combustion takes place in the chamber and the walls are normally provided with expansion gaps enabling them to expand as their temperature rises.

Attempts have been made to fill these expansion gaps with a resilient packing material which will withstand the heat of the combustion taking place in the chamber and will prevent material in the chamber passing into the gaps.

Fluidised bed combustors and furnaces employ a bed of inert material, usually sand through which air is passed to agitate and keep the bed in motion. The inert material of the bed warms during combustion and aids and supports combustion of materials fed thereto.

In fluidised bed combustors and furnaces it has been found that the inert material forming the bed acts as an abrasive wearing away packing material in the expansion gaps. As soon as the packing material has worn away the inert material percolates into the gaps filling them and preventing expansion of the walls.

Arrangements for filling the expansion gaps with particularly hard materials, such as ceramic fibers, have proved ineffective as it has been found that the inert material of the bed percolates into the interstices of the fiber, fills the gaps and prevents expansion of the walls.

If the walls cannot properly expand when the heated chamber warms they may buckle and fail.

An object of this invention includes the provision of wall arrangement alleviating or meeting this problem.

One aspect of the present invention provides a wall arrangement for a heated chamber, said walls having gaps enabling expansion of the walls when the temperature of the chamber is increasing and including means for preventing inert material packing said gaps so as to prevent expansion of said walls.

Said means may include means for promoting movement, in the gaps, of any of said material that falls therein, and may include means for injecting gas into the or each gap to maintain inert material falling into said gap in motion. The gas may be air, flue-gas or a furnace atmosphere.

A fluidised bed combustor or furnace embodying the invention provides that said means include one or more sparge pipes individually located adjacent respective ones of a plurality of expansion gaps and arranged to direct air thereinto. Each said sparge pipe preferably extends through an outer casing of the combustion chamber and lies immediately behind its associated expansion gap formed in the lining of said combustion chamber.

Each said sparge pipe preferably lies between the refractory lining of a fluidised bed combustion chamber and the casing of the fluidised bed tank and acts to support said refractory lining relative to the outer casing of the combustion chamber.

Further aspects of the present invention provide a fluidised bed combustion chamber or furnace as defined above, further including means for supplying air to the or each said sparge pipe only whilst said combustion chamber is below its normal operating temperature.

Figure 2:
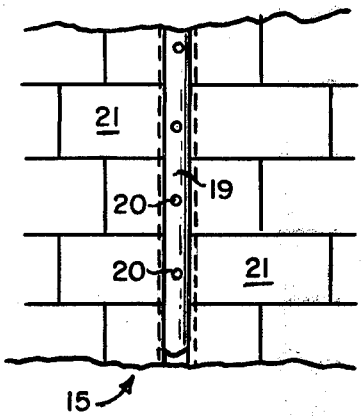
Figure 3:
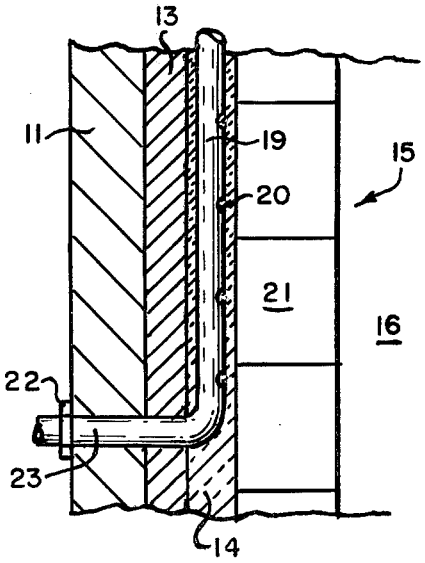
Figure 4:
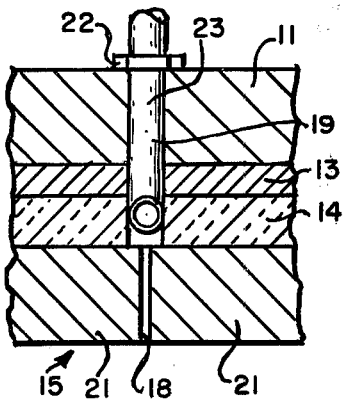
Figure 5:
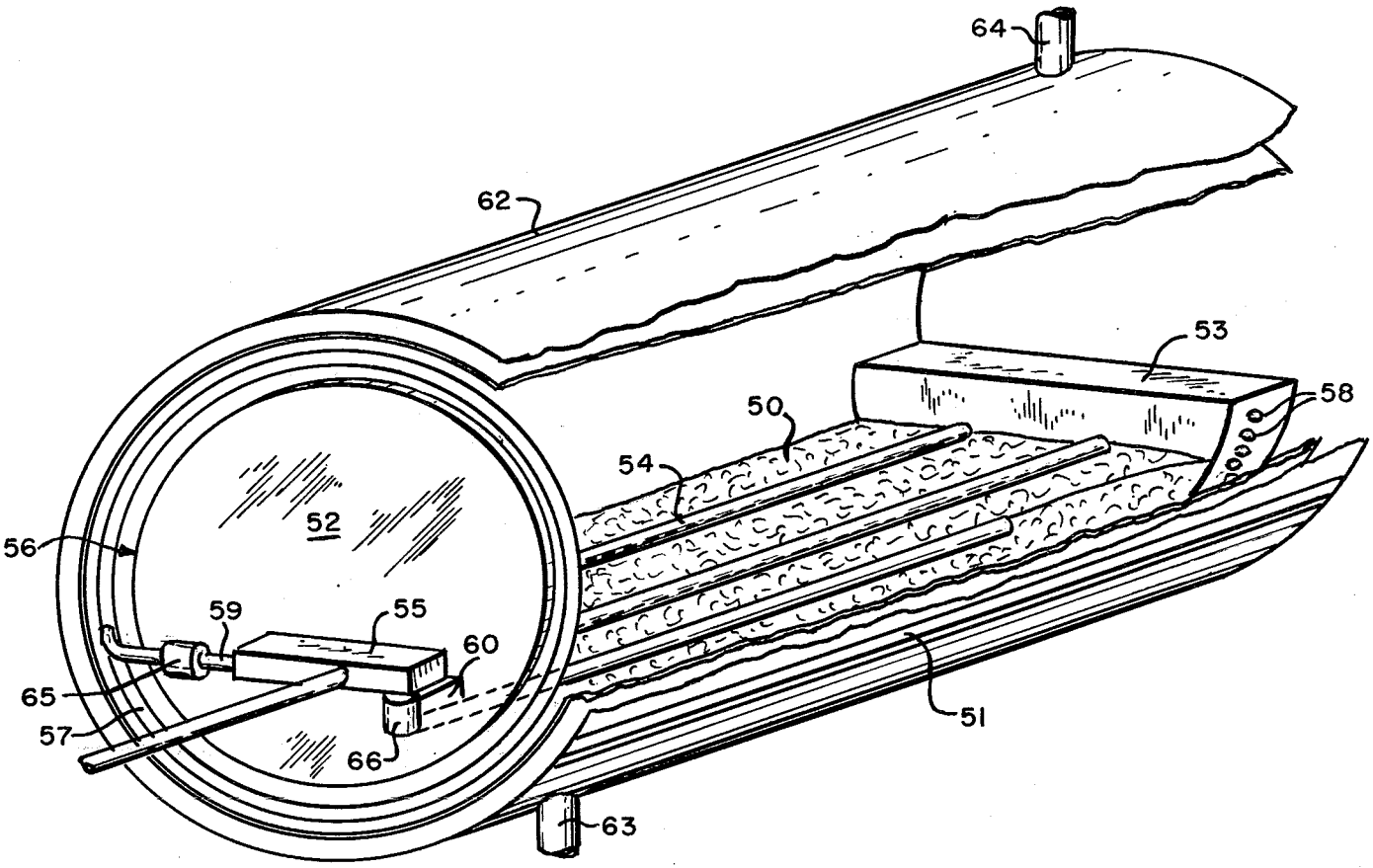

Fluidised bed of combustion chamber apparatus embodying the present invention will now be described with reference to the accompanying drawings in which:

FIG. 1 is a schematic plan view of a fluidised bed combustion chamber embodying the present invention, FIG. 2 is a face view, to an enlarged scale, of part of a wall of the fluidised bed combustion chamber of FIG. 1, FIG. 3 is a sectional side elevation drawn on the line III—III of FIG. 2, FIG. 4 is a plan view of the detail arrangement of FIG. 2, FIG. 5 is a schematic perspective view showing a fluid bed shell type boiler.

FIGS. 1 to 4 show a fluidised bed combustion chamber 10 having an outer casing 11 surrounding an inner, fluidised bed, tank 12. The tank 12 comprises a casing 13 surrounding an insulating layer 14 itself surrounding a refractory lining 15. The refractory lining 15 bounds a fluidised bed 16 fed, in use, with air via an array of sparge pipes 17 as shown.

Air from the pipes 17 fluidises the inert material, usually sand, of the bed 16 enabling the bed to support combustion of any combustible materials fed to it.

The combustion chamber may be used for any desired purpose, for example it may be used to dry materials fed to it or to produce steam (in the case where the fluidised bed arrangement is used in a boiler).

The lining 15 of the fluidised bed combustion chamber is formed of refractory bricks 21.

Brickwork expands when heated (a linear expansion of up to 0.7% with a temperature rise of approximately 850° being usual) and to enable expansion of the wall without it buckling vertical gaps 18 are provided in the wall as shown. The gaps are approximately 7 mm wide and are spaced in the wall approximately 1 meter apart along its length.

It has been found that when using the arrangement as so far described the gaps 18 fill with the inert material of the bed 16. This prevents the walls properly expanding and, in extreme cases, causes the refractory lining 15 to buckle and fail. The known methods of preventing this percolation of the inert material into the gaps, for example by packing the gaps 18 with a resilient material have been found to be ineffective because of abrasion by the moving inert bed material and if the gaps are filled with a hard material (such as a ceramic fibre packing) the inert bed material tends to fill the interstices of the fibrous material packing the gap and preventing the wall properly expanding.

The described embodiment overcomes this problem by providing a vertical sparge pipe 19 located to extend immediately behind each gap 18. Each vertical sparge pipe 19 is located in an insulating layer 14 surrounding the refractory lining 15 of the fluid bed tank. The apertures 20 of the sparge pipes 19 are directed towards the gaps 18 so that air from the sparge pipes passes into the expansion gaps 18 and acts to keep any inert material that percolates into the gaps in motion, thereby preventing the material packing the gaps 18.

At their bottom ends the sparge pipes 19 turn through an angle of 90° and pass out of the fluid bed tank casing 13 and through the outer casing 11. The sparge pipes 19 are fixed to the external walls 11 of the combustion chamber by any suitable means such as nuts 22 as shown, which enable the sparge pipes 19, (especially their bottom, horizontally disposed of sections 23 to act as ties locating and stabilizing the fluidised bed tank within the outer casing 11.

The sparge pipes 19 may be supplied with air from a supply separate to that which supplies air to the main array of sparge pipes 17 in the bed 16. Alternatively, the sparge pipes 19 may be supplied with air from that main air supply 23 passing air to the sparge pipes 17.

It is found to be not necessary to continue supplying air to the sparge pipes 19 once the combustion chamber reaches its normal operating temperature. At this time, the supply of air to the sparge pipes 19 may be cut off (if supplied from a separate supply) or as schematically shown in FIG. 1, a solenoid valve 24 may be operated, in dependence upon the temperature in the combustion chamber, to prevent air flowing from the main air supply 23 to the sparge pipes 19.

When the supply of air to the sparge pipes 19 ceases, air no longer passes to the expansion gaps 18 in the refractory lining 15 and the inert material of the bed may percolate into and fill the gaps 18. At this time, the bed has reached its operating temperature and the gaps 18 are at their minimum size so that their filling with inert bed material is not detrimental and, in fact, may aid heat retention in the combustion chamber.

FIG. 5 shows the invention applied to a shell type boiler in which a fluid bed 50 is supported in a furnace or flame-tube 51 of a sheet type boiler having a front plate 52 and a rear wall 53. The boiler is provided with a jacket 62 to which water is supplied from an inlet 63 and from which heated water or steam may be extracted at an outlet 64.

Air is fed to the fluid bed 50 via an array of sparge pipes 54 extending between the front plate 52 and rear wall 53 as shown from a plenum chamber 55.

The annular gap 56 between the front plate 52 and furnace tube 51 has an annular sparge pipe 57 located in it as shown with its apertures directed toward the interior of the furnace tube 51.

The rear wall 53 is formed as a hollow box having a plurality of apertures 58 found in its periphery as shown.

Air is fed to the sparge pipe 57 and hollow rear wall 53 from the plenum chamber via pipe lines 59 and 60, respectively pipe line 60 extending through the fluid bed 50 below the sparge pipes 54 in that part of the bed that does not normally move. Alternatively, the elements 57 and 58 may be supplied with air from a separate supply.

Valves 65 and 66 may be provided in the pipes 59 and 60 respectively, enabling the flow or air to sparge pipe 57 and rear wall 52 to be turned off when the bed reaches its normal operating temperature. The valves 65 and 66 may be operable manually or, as in the case of the valve 24 or FIG. 1 electrically. In using this arrangement bed material percolating into the gaps between the furnace tube 51, the front plate 52 and rear wall 53 is kept in motion (at least while the bed temperature is rising) preventing the nickel chrome casing, front plate and rear walls buckling as they expand.

It will be appreciated that the present invention is not limited to fluidised bed combustion arrangements and may be used, to prevent ingress into an expansion gap of any inert solid material which would, in use, fill the gaps and prevent proper expansion of the combustor or furnace walls to take place.

What is claimed:

1. A chamber housing a bed of finely divided inert particulate material which bed is fluidizable, and which chamber is heated and comprises an outer casing and inner wall, which inner wall bounds the fluidised bed, said inner wall being at least in part sectioned so as to provide an elongated gap between said sections extending along the length thereof, enabling expansion of the wall sections as the temperature thereof increases and means arranged in association with each said gap for promoting movement along the length thereof of any particulate bed material entering therein thereby preventing said particulate material from packing said gap and from inhibiting expansion of said wall.

2. The chamber according to claim 1 in which said means for promoting movement of said particulate material comprises gas injecting means operable to inject gas into said gap.

3. The chamber according to claim 2 in which said gas injecting means is operable to inject air into said gap.

4. A combustor or furnace of the fluidized bed shell type boiler comprising a furnace tube, a front end wall, a rear end wall and a plurality of fluidizing sparge tubes extending between said front and rear end walls, said front end wall and said rear end wall being mounted to provide an annular gap with respect to inner surface of said furnace tube, and at least one sparge pipe provided within said gap between said front end wall and said furnace tube.

5. The combustor or furnace according to claim 4 wherein said rear end wall is hollow and the periphery of which is perforated by a plurality of apertures to allow air passed to the rear wall to issue into the gap between the rear wall and the furnace tube.

6. The combustor or furnace according to claim 5 including means for supplying said annular sparge pipe only whilst said combustor is below its normal operating temperature.

7. The combustor or furnace according to claim 4 including valve means operable to prevent the supply of gas to said annular sparge pipe as soon as said combustor reaches its normal operating temperature.

8. The combustor or furnace according to claim 7 including means for supplying air to said annular sparge pipe from a main air supply to the fluidizing sparge pipes located within the fluidized bed.

9. The combustor or furnace according to claim 7 wherein the supply of gas to said annular sparge pipe is controlled by one or more solenoid valves operated in dependence upon the temperature of the combustor.

* * * * *